US011490193B2

(12) United States Patent
Wang et al.

(10) Patent No.: US 11,490,193 B2
(45) Date of Patent: Nov. 1, 2022

(54) TERMINAL APPARATUS

(71) Applicant: GOERTEK INC., Weifang (CN)

(72) Inventors: Xinglong Wang, Weifang (CN); Zhilei Han, Weifang (CN)

(73) Assignee: GOERTEK INC., Weifang (CN)

( * ) Notice: Subject to any disclaimer, the term of this patent is extended or adjusted under 35 U.S.C. 154(b) by 0 days.

(21) Appl. No.: 17/264,571

(22) PCT Filed: May 31, 2019

(86) PCT No.: PCT/CN2019/089451
§ 371 (c)(1),
(2) Date: Jan. 29, 2021

(87) PCT Pub. No.: WO2020/034728
PCT Pub. Date: Feb. 20, 2020

(65) Prior Publication Data

US 2021/0321191 A1 Oct. 14, 2021

(30) Foreign Application Priority Data

Aug. 13, 2018 (CN) ..... 201810919602.5

(51) Int. Cl.
*H04R 1/34* (2006.01)
*H04R 1/02* (2006.01)
(Continued)

(52) U.S. Cl.
CPC ..... *H04R 1/345* (2013.01); *H04R 1/023* (2013.01); *H04R 1/025* (2013.01); *H04R 9/025* (2013.01);
(Continued)

(58) Field of Classification Search
CPC ..... H04R 1/345; H04R 1/023; H04R 1/025; H04R 9/025; H04R 9/06; H04R 2400/11; H04R 2499/11
(Continued)

(56) References Cited

U.S. PATENT DOCUMENTS 8,045,323 B2 * 10/2011 Murakata ..... H01M 50/271 361/679.01
2005/0067216 A1 * 3/2005 Schuhmann ..... H04M 1/18 181/149
(Continued)

FOREIGN PATENT DOCUMENTS

CN 102333259 A 1/2012
CN 204131710 U 1/2015
(Continued)

OTHER PUBLICATIONS

International Search Report dated Aug. 27, 2019; PCT/CN2019/089451.

*Primary Examiner* — Sean H Nguyen

(57) ABSTRACT

Disclosed is a terminal apparatus, including a protective shell and a sounding device installed in the protective shell, where the sounding device includes a vibration system and a magnetic circuit system; where the vibration system includes a vibration diaphragm including a first surface and a second surface facing away from the first surface; the magnetic circuit system is located on a side of the second surface of the vibration diaphragm; the sounding device defines a first sounding hole at a position in communication with a space on a side of the first surface, and a second sounding hole at a position in communication with a space on the side of the second surface; and the protective shell defines a first terminal sounding hole in communication with
(Continued)

the first sounding hole, and a second terminal sounding hole in communication with the second sounding hole.

15 Claims, 7 Drawing Sheets

(51) Int. Cl.
*H04R 9/02* (2006.01)
*H04R 9/06* (2006.01)

(52) U.S. Cl.
CPC ..... *H04R 9/06* (2013.01); *H04R 2400/11* (2013.01); *H04R 2499/11* (2013.01)

(58) Field of Classification Search
USPC ..... 381/334
See application file for complete search history.

(56) References Cited

U.S. PATENT DOCUMENTS

2012/0202559 A1* 8/2012 Shiogama ..... H04R 1/021
381/386
2017/0251564 A1* 8/2017 Jun ..... H04R 1/02

FOREIGN PATENT DOCUMENTS

CN 105227719 A 1/2016
CN 107948891 A 4/2018
CN 109218938 A 1/2019

* cited by examiner

TERMINAL APPARATUS

TECHNICAL FIELD

The present disclosure relates to the technical field of speakers, in particular to a terminal apparatus.

BACKGROUND

Terminal apparatuses (such as mobile phones, cordless phones, laptops, digital cameras, Bluetooth headsets, etc.) have become commonplace in people's daily lives. For the speaker, an important component in the terminal apparatus, the vibration diaphragm will radiate sound wave energy forward and backward when it works. Generally, the speaker only utilizes the sound wave energy radiated in the forward direction, but does not make good use of the sound wave energy radiated in the rearward direction. Therefore, the existing speakers generally can only achieve a one-way sounding function, which largely restricts the application of the speakers.

SUMMARY

The main object of the present disclosure is to provide a terminal apparatus, which aims to realize the bidirectional sounding function of the sounding device.

To achieve the above object, the terminal apparatus provided by the present disclosure includes a protective shell and a sounding device installed in the protective shell, where the sounding device includes a vibration system and a magnetic circuit system; where the vibration system includes a vibration diaphragm including a first surface and a second surface facing away from the first surface;

the magnetic circuit system is located on a side of the second surface of the vibration diaphragm;

the sounding device defines a first sounding hole at a position in communication with a space on a side of the first surface, and a second sounding hole at a position in communication with a space on the side of the second surface; and the protective shell defines a first terminal sounding hole in communication with the first sounding hole, and a second terminal sounding hole in communication with the second sounding hole.

Optionally, the sounding device further includes:

a housing, defining an accommodating cavity therein, where the first sounding hole and the second sounding hole are defined on a cavity wall of the accommodating cavity; and a sounder comprising the vibration system and the magnetic circuit system, wherein the sounder is accommodated in the accommodating cavity and defines a front sounding hole and a rear sounding hole, the front sounding hole is in communication with the first sounding hole, and the rear sounding hole is in communication with the second sounding hole.

Optionally, the front sounding hole is defined on a top surface of the sounder, and the rear sounding hole is defined on a bottom surface or a side surface of the sounder.

Optionally, an air guiding channel is defined between a surface of the sounder and the cavity wall of the accommodating cavity, and the rear sounding hole and the second sounding hole are communicated through the air guiding channel.

Optionally, the sounder is fixedly connected to a cavity wall of the accommodating cavity surrounding the first sounding hole, and the front sounding hole and the first sounding hole are arranged oppositely.

Optionally, the accommodating cavity defines an avoiding hole spaced apart from the second sounding hole on the cavity wall, a connector is protruded from a side wall of the avoiding hole, a strength of the connector is higher than a strength of plastic, the connector is extended along a circumference of the avoiding hole, and an inner side of the connector defines the first sounding hole; and the sounder is fixedly connected to the connector, and the front sounding hole and the first sounding hole are arranged oppositely.

Optionally, the housing includes a first housing and a second housing, the first housing is covered on the second housing and enclosed with the second housing to define the accommodating cavity, the first housing defines the first sounding hole, and the second housing defines the second sounding hole.

Optionally, the housing is in a rectangular parallelepiped shape, and the first sounding hole and the second sounding hole are arranged oppositely.

Optionally, the first housing and the second housing are glued or ultrasonically welded.

Optionally, the sounding device further includes a dust-proof screen arranged at the first sounding hole and blocking the first sounding hole.

Optionally, the dust-proof screen is accommodated in the accommodating cavity, the dust-proof screen includes a screen and a first frame arranged around an outer periphery of the screen, the first frame is arranged around the first sounding hole and fixedly connected to a cavity wall of the accommodating cavity surrounding the first sounding hole, the screen is covered on the first sounding hole, and a surface of the sounder surrounding the front sounding hole is arranged around and fixedly connected to the first frame.

Optionally, the sounding device further includes a waterproof and breathable member arranged at the second sounding hole and blocking the second sounding hole.

Optionally, the waterproof and breathable member includes a waterproof and breathable layer and a second frame arranged around an outer periphery of the waterproof and breathable layer, the second frame is arranged around the second sounding hole, the waterproof and breathable layer is covered on the second sounding hole, the second frame is fixedly connected to a cavity wall of the accommodating cavity surrounding the second sounding hole or fixedly connected to an outer surface of the housing surrounding the second sounding hole;

or, the waterproof and breathable member is a waterproof and breathable layer, and an outer periphery of the waterproof and breathable layer is integrally molded on a side wall of the second sounding hole.

Optionally, the sounding device further includes a waterproof tape arranged on a surface of the housing and surrounding the first sounding hole;

and/or, two opposite side walls of the first sounding hole are provided with a reinforcing rib transversely.

Optionally, the sounding device includes an annular frame, the vibration system is installed at a first end of the frame, the magnetic circuit system is installed inside the frame and located below the vibration system, the frame is further provided with a front cover at the first end, the front cover defines the first sounding hole, the frame is provided with a rear cover at a second end, and the rear cover defines the second sounding hole.

Optionally, the protective shell includes a front face, a back face arranged oppositely to the front face, and a side face connecting the front face and the back face, the first terminal sounding hole is defined on the front face of the protective shell, and the second terminal sounding hole is defined on the back face of the protective shell; or, the first terminal sounding hole is defined on the side face of the protective shell, and the second terminal sounding hole is defined on the back face of the protective shell; or, the first terminal sounding hole is defined on the front face of the protective shell, and the second terminal sounding hole is defined on the side face of the protective shell.

According to the technical solution of the present disclosure, when the sounding device is working, the vibration diaphragm of the vibration system vibrates to radiate sound wave energy in the forward direction (a side of the first surface of the vibration diaphragm) and the backward direction (a side of the second surface of the vibration diaphragm) respectively. At this time, the sound wave energy radiated in the forward direction flows out through the first sounding hole on the sounding device, and radiates outward from the front face of the sounding device to generate sound; the sound wave energy radiated in the rearward direction flows out through the second sounding hole on the sounding device, and radiates outward from the side face or back face of the sounding device to generate sound. In this way, the bidirectional sounding function of the sounding device is realized, the utilization rate of the sound wave energy of the sounding device is improved, and the application range of the sounding device is broadened. Moreover, compared with most of the existing dual-diaphragm speaker products on the market, the sounding device of the present disclosure also has the advantages of simple structure, low process difficulty, and high reliability. For the dual-diaphragm design, when the second vibration diaphragm is a non-permeable material, the sound wave generated by the first vibration diaphragm is transmitted to the second vibration diaphragm to vibrate and then generate sound. Since the second vibration diaphragm generates sound through vibration, transmission loss will occur. However, the present disclosure adopts a waterproof and breathable member, and sound is transmitted through its micro pores, so that transmission loss is not easy to occur, and excellent sound characteristics in the second direction can be achieved. In order to correspond to the bidirectional sounding function of the sounding device, the protective shell of the terminal apparatus of the present disclosure further defines a first terminal sounding hole in communication with the first sounding hole, and a second terminal sounding hole in communication with the second sounding hole.

BRIEF DESCRIPTION OF THE DRAWINGS

In order to more clearly explain the embodiments of the present disclosure or the technical solutions in the prior art, the drawings used in the description of the embodiments or the prior art will be briefly introduced below. Obviously, the drawings in the following description are merely some embodiments of the present disclosure. For those of ordinary skill in the art, other drawings can be obtained based on the structure shown in these drawings without paying creative work.

DESCRIPTION OF REFERENCE NUMERALS

Figure 1:
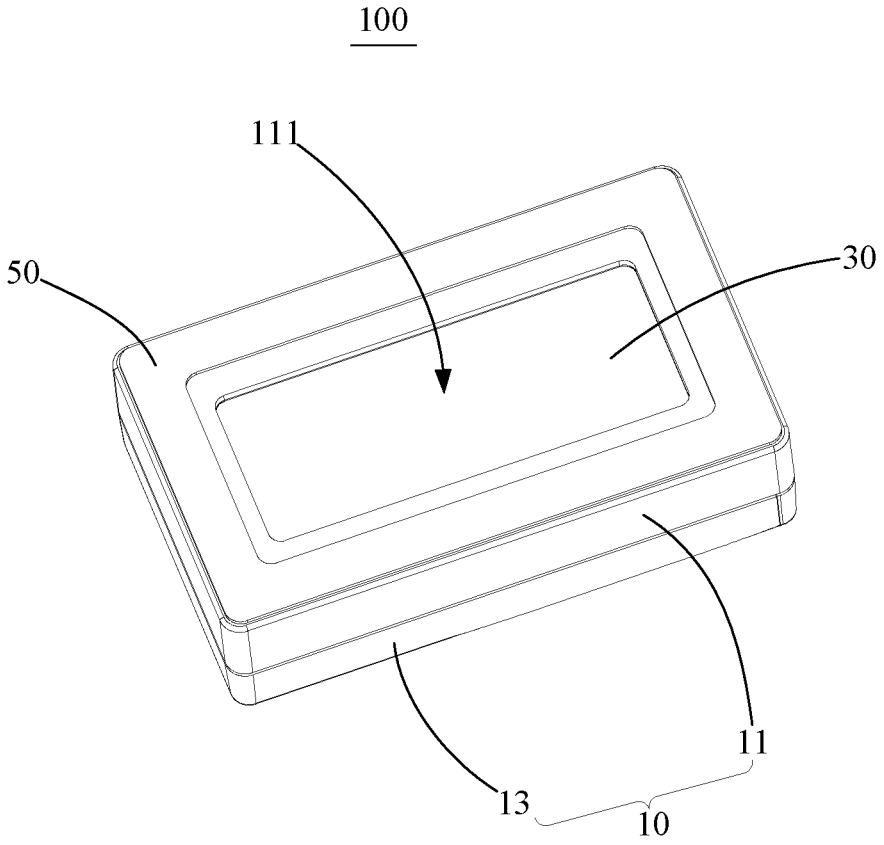
FIG. 1 is a schematic structural diagram of a sounding device according to an embodiment of the present disclosure.
Figure 2:
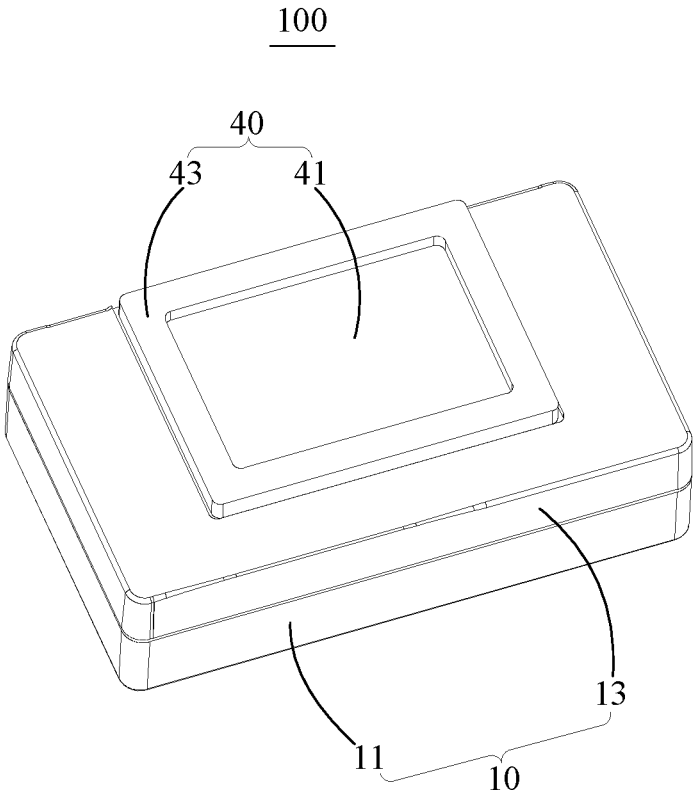
FIG. 2 is a schematic structural diagram of the sounding device in FIG. 1 from another perspective.

| No. | Name | No. | Name |
|---|---|---|---|
| 100 | Sounding device | 33 | First frame |
| 10 | Housing | 40 | Waterproof and breathable member |
| 10a | Air guiding channel | 41 | Waterproof and breathable layer |
| 11 | First housing | 43 | Second frame |
| 111 | First sounding hole | 50 | Waterproof tape |
| 1111 | Reinforcing rib | 60a | Frame |
| 113 | Housing body | 60b | Front cover |
| 115 | Connector | 60c | Rear cover |
| 13 | Second housing | 70 | Vibration system |
| 131 | Second sounding hole | 80 | Magnetic circuit system |
| 20 | Sounder | 200 | Protective shell |
| 20a | Front sounding hole | 210 | First terminal sounding hole |
| 30 | Dust-proof screen | 230 | Second terminal sounding hole |
| 31 | Screen | 300 | Terminal apparatus |

The realization of the objects, functional characteristics and advantages of this disclosure will be further described in conjunction with the embodiments and with reference to the drawings.

DETAILED DESCRIPTION OF THE EMBODIMENTS

In the following, the technical solutions in the embodiments of the present disclosure will be clearly and completely described with reference to the drawings in the embodiments of the present disclosure. Obviously, the described embodiments are only a part of the embodiments of the present disclosure, but not all of the embodiments. Based on the embodiments of the present disclosure, all other embodiments obtained by those of ordinary skill in the art without creative efforts shall fall within the protection scope of the present disclosure.

It should be noted that all directional indicators (such as up, down, left, right, front, back, etc.) in the embodiments of the present disclosure are only used to explain the relative positional relationship, movement situation, etc. between components in a specific posture (as shown in the drawings). If the specific posture changes, the directional indication also changes accordingly.

In addition, if there are descriptions involving "first", "second", etc. in the embodiments of the present disclosure, the descriptions of "first", "second", etc. are only used for descriptive purposes, and cannot be understood as instructions or implications of its relative importance or implicitly indicates the number of technical features indicated. Therefore, the features defined with "first" and "second" may explicitly or implicitly include at least one of the features. In the description of the present disclosure, "a plurality of" means at least two, such as two, three, etc., unless otherwise specifically defined.

In the present disclosure, unless otherwise clearly specified and limited, the terms "connected", "fixed", etc. should be understood in a broad sense. For example, "fixed" can be a fixed connection, a detachable connection, or a whole; it can be a mechanical connection or an electrical connection; it can be a direct connection or an indirect connection through an intermediary, and it can be the internal communication between two components or the interaction relationship between two components, unless specifically defined otherwise. For those of ordinary skill in the art, the specific meanings of the above terms in the present disclosure can be understood according to specific circumstances.

In addition, the technical solutions between the various embodiments can be combined with each other, but they must be based on what can be achieved by those of ordinary skill in the art. When the combination of technical solutions is contradictory or cannot be achieved, it should be considered that such a combination of technical solutions does not exist, nor within the protection scope of the present disclosure.

The present disclosure provides a sounding device 100, which aims to realize the bidirectional sounding function of the sounding device 100. The sounding device 100 includes a vibration system 70 and a magnetic circuit system 80 (refer to FIG. 7); where the vibration system 70 includes a vibration diaphragm including a first surface and a second surface facing away from the first surface;

the magnetic circuit system 80 is located on a side of the second surface of the vibration diaphragm;

the sounding device 100 defines a first sounding hole 111 at a position in communication with a space on a side of the first surface, and a second sounding hole 131 at a position in communication with a space on the side of the second surface; and a waterproof and breathable member 40 is provided on the second sounding hole 131.

When the sounding device 100 is working, the vibration diaphragm of the vibration system 70 vibrates to radiate sound wave energy in the forward direction (a side of the first surface of the vibration diaphragm) and the rearward direction (a side of the second surface of the vibration diaphragm) respectively. At this time, the sound wave energy radiated in the forward direction flows out through the first sounding hole 111 on the sounding device 100, and radiates outward from the front face of the sounding device 100 to generate sound; the sound wave energy radiated in the rearward direction flows out through the second sounding hole 131 on the sounding device 100, and radiates outward from the side face or back face of the sounding device 100 to generate sound. In this way, the bidirectional sounding function of the sounding device 100 is realized, the utilization rate of the sound wave energy of the sounding device 100 is improved, and the application range of the sounding device 100 is broadened. Moreover, compared with most of the existing dual-diaphragm speaker products on the market, the sounding device 100 of the present disclosure also has the advantages of simple structure, low process difficulty, and high reliability. For the dual-diaphragm design, when the second vibration diaphragm is a non-permeable material, the sound wave generated by the first vibration diaphragm is transmitted to the second vibration diaphragm to vibrate and then generate sound. Since the second vibration diaphragm generates sound through vibration, transmission loss will occur. However, the present disclosure adopts a waterproof and breathable member 40, and sound is transmitted through its micro pores, so that transmission loss is not easy to occur, and excellent sound characteristics in the second direction can be achieved.

The specific structure of the sounding device 100 of the present disclosure will be described below.

As shown in FIGS. 1 to 4, in an embodiment of the sounding device 100 of the present disclosure, the sounding device 100 further includes:

a housing 10, defining an accommodating cavity (not marked) therein, where the first sounding hole 111 and the second sounding hole 131 are defined on a cavity wall of the accommodating cavity; and a sounder 20 including the vibration system and the magnetic circuit system, where the sounder 20 is accommodated in the accommodating cavity and defines a front sounding hole 20*a* and a rear sounding hole (not marked), the front sounding hole 20*a* is in communication with the first sounding hole 111, and the rear sounding hole is in communication with the second sounding hole 131.

Specifically, the front sounding hole 20*a* is defined on a top surface of the sounder 20, and the rear sounding hole is defined on a bottom surface or a side surface of the sounder 20. In this way, the mutual interference between the forward sound waves and the rearward sound waves of the vibration diaphragm can be effectively avoided, so that the bidirectional sounding quality of the sounding device 100 is better.

An air guiding channel 10*a* is defined between a surface of the sounder 20 and the cavity wall of the accommodating cavity, and the rear sounding hole and the second sounding hole 131 are communicated through the air guiding channel 10*a*. In this way, not only can the rear sounding hole and the second sounding hole 131 be communicated, the bidirectional sounding function of the sounding device 100 can be more easily realized, but also the structure is simple, the processing is convenient, and the assembly is convenient.

In this embodiment, the housing 10 is roughly in a rectangular parallelepiped shape, and the accommodating cavity therein is also roughly in a rectangular parallelepiped shape. A top wall and a bottom wall of the accommodating cavity respectively defines the first sounding hole 111 and the second sounding hole 131. The sounder 20 is also roughly in a rectangular parallelepiped shape, and its size is smaller than a size of the accommodating cavity, so that the sounder 20 can be accommodated in the accommodating cavity.

It is understandable that a front cover of the sounder 20 defines a front sounding hole 20*a* for sound waves to be emitted, and a plastic shell of the sounder 20 defines a rear sounding hole for balancing an internal pressure of the sounder 20 (of course, in other embodiments, the rear sounding hole for balancing the internal pressure of the sounder 20 can also be defined on the magnetic circuit system). When the sounder 20 is accommodated in the accommodating cavity, the sounder 20 can be directly connected to the cavity wall of the accommodating cavity through a snap-fit connection, screw connection, threaded connection, glue connection, or other reasonable and effective connection ways to achieve fixation, or indirectly connected to the cavity wall of the accommodating cavity through an intermediate part (such as a bracket) to achieve fixation. At this time, the front sounding hole 20*a* of the sounder 20 is disposed facing the first sounding hole 111 and in communication with the first sounding hole 111. The specific communication method can be achieved through a pipe such as a conduit, or an outer surface of the front cover (of the sounder 20) surrounding the front sounding hole 20*a* is closely attached to the cavity wall of the accommodating cavity surrounding the first sounding hole 111, so that the front sounding hole 20*a* of the sounder 20 and the first sounding hole 111 are directly communicated. At the same time, since the size of the sounder 20 is smaller than the size of the accommodating cavity, there can be a certain distance between the surface of the sounder 20 and the cavity wall of the accommodating cavity to form an air guiding channel 10*a*, thereby using the air guiding channel 10*a* to communicate the rear sounding hole of the sounder 20 with the second sounding hole 131 (of course, in some other embodiments, the rear sounding hole may be defined on the bottom surface of the sounder 20, at this time, it is also fine if there is no distance between the surface of the sounder 20 and the cavity wall of the accommodating cavity).

In this way, when the sounding device 100 is working, the vibration diaphragm of the sounder 20 vibrates to radiate sound wave energy in a forward direction (a side of the vibration diaphragm facing the first sounding hole 111) and a rearward direction (a side of the vibration diaphragm facing away from the first sounding hole 111)) respectively. At this time, the sound wave energy radiated in the forward direction flows out through the front sounding hole 20*a* on the sounder 20 and through the first sounding hole 111 on the housing 10 of the sounding device 100, and radiates sound from the front face of the sounding device 100; the sound wave energy radiated in the rearward direction flows into the air guiding channel 10*a* in the housing 10 of the sounding device 100 through the rear sounding hole on the sounder 20, and then flows out through the second sounding hole 131 on the housing 10 of the sounding device 100, and radiates outward from the side face or back face of the sounding device 100 to generate sound. In this way, the bidirectional sounding function of the sounding device 100 is realized, the utilization rate of the sound wave energy of the sounding device 100 is improved, and the application range of the sounding device 100 is broadened. Moreover, compared with most of the existing dual-diaphragm speaker products on the market, the sounding device 100 of the present disclosure also has the advantages of simple structure, low process difficulty, and high reliability. For the dual-diaphragm design, when the second vibration diaphragm is a non-permeable material, the sound wave generated by the first vibration diaphragm is transmitted to the second vibration diaphragm to vibrate and then generate sound. Since the second vibration diaphragm generates sound through vibration, transmission loss will occur. However, the present disclosure adopts a waterproof and breathable member 40, and sound is transmitted through its micro pores, so that transmission loss is not easy to occur, and excellent sound characteristics in the second direction can be achieved.

In an embodiment of the sounding device 100 of the present disclosure, the sounder 20 is fixedly connected to a cavity wall of the accommodating cavity surrounding the first sounding hole 111, and the front sounding hole 20*a* and the first sounding hole 111 are arranged oppositely.

That is, a surface of the sounder 20 surrounding the front sounding hole 20*a* is arranged around the first sounding hole 111 and is fixedly connected to a cavity wall of the accommodating cavity surrounding the first sounding hole 111.

That is, an outer surface of a front cover (of the sounder 20) surrounding the front sounding hole 20*a* is arranged around the first sounding hole 111 and is fixedly connected to a cavity wall of the accommodating cavity surrounding the first sounding hole 111. Specifically, the front cover and the cavity wall can be directly fixed and connected by glue connection, snap connection, screw connection, or other reasonable and effective ways, or indirectly fixed and connected through an intermediate part (such as a sealing ring, air guide ring, frame, bracket etc.) by glue connection, snap connection, screw connection, or other reasonable and effective ways.

In this way, a position of the front sounding hole 20*a* can be close to a position of the first sounding hole 111, so that the front sounding hole 20*a* can face the first sounding hole 111, and the sound wave energy radiated in the forward direction of the sounder 20 can smoothly pass through the first sounding hole 111 to sound outward. In addition, the structure is simple, the manufacturing is convenient, the assembly is fast, and the stability and reliability are high.

As shown in FIGS. 1 to 4, in an embodiment of the sounding device 100 of the present disclosure, the accommodating cavity defines an avoiding hole spaced apart from the second sounding hole 131 on the cavity wall, a connector 115 is protruded from a side wall of the avoiding hole, a strength of the connector 115 is higher than a strength of plastic, the connector 115 is extended along a circumference of the avoiding hole, and an inner side of the connector 115 defines the first sounding hole 111; and the sounder 20 is fixedly connected to the connector 115, and the front sounding hole 20*a* and the first sounding hole 111 are arranged oppositely.

In this embodiment, a top wall of the accommodating cavity inside the housing 10 defines the avoiding hole, and a bottom wall of the accommodating cavity inside the housing 10 defines a second sounding hole 131. A side wall of the avoiding hole defines an installation groove, and the installation groove is extended along a circumferential direction of the avoiding hole and communicated end to end to form an annular installation groove. At this time, the connector 115 is annular and has an outer periphery and an inner periphery. The connector 115 is arranged around the avoiding hole, and the outer periphery of the connector 115 is inserted and clamped in the installation groove, and the inner periphery of the connector 115 is enclosed to define the first sounding hole 111. It should be noted that a structure in which the outer periphery of the connector 115 is inserted and clamped in the installation groove can be obtained by integral injection molding in a mold.

At this time, the outer surface of the front cover (of the sounder 20) surrounding the front sounding hole 20*a* is arranged around the first sounding hole 111 and is fixedly connected to a lower surface of the connector 115 surrounding the first sounding hole 111. Specifically, the front cover and the connector 115 can be directly fixed and connected by glue connection, snap connection, screw connection, or other reasonable and effective ways, or indirectly fixed and connected through an intermediate part (such as a sealing ring, air guide ring, frame, bracket etc.) by glue connection, snap connection, screw connection, or other reasonable and effective ways.

In addition, the connector 115 can usually be made of a rigid material, such as a steel sheet or a ceramic sheet, so that its strength is higher than that of plastic.

In this way, not only a thickness of the side wall of the first sounding hole 111 can be effectively reduced, and a volume of the sounding device 100 can be reduced, but also the installation stability of the sounding device 20 can be effectively improved, the structural stability of the sounding device 100 can be improved, and the sound generation quality of the sounding device 100 can be improved.

As shown in FIGS. 1 to 4, in an embodiment of the sounding device 100 of the present disclosure, the housing 10 includes a first housing 11 and a second housing 13, the first housing 11 is covered on the second housing 13 and enclosed with the second housing 13 to define the accommodating cavity, the first housing 11 defines the first sounding hole 111, and the second housing 13 defines the second sounding hole 131.

In this way, the first housing 11 or the second housing 13 can be opened or closed, so that the accommodating cavity inside the housing 10 can be exposed or hidden, thereby facilitating the arrangement, arrangement, and connection and fixation of various components therein. In this way, the production efficiency of the sounding device 100 can be greatly improved, and its reliability can be improved.

Further, the housing 10 is in a rectangular parallelepiped shape, and the first sounding hole 111 and the second sounding hole 131 are arranged oppositely. In this way, not only the structure of the sounding device 100 is simpler, the processing is more convenient, and the assembly is faster, but also the bidirectional sounding of the sounding device 100 is smoother.

Specifically, the first housing 11 and the second housing 13 may be connected by gluing, ultrasonic welding, or other reasonable and effective ways.

Figure 3:
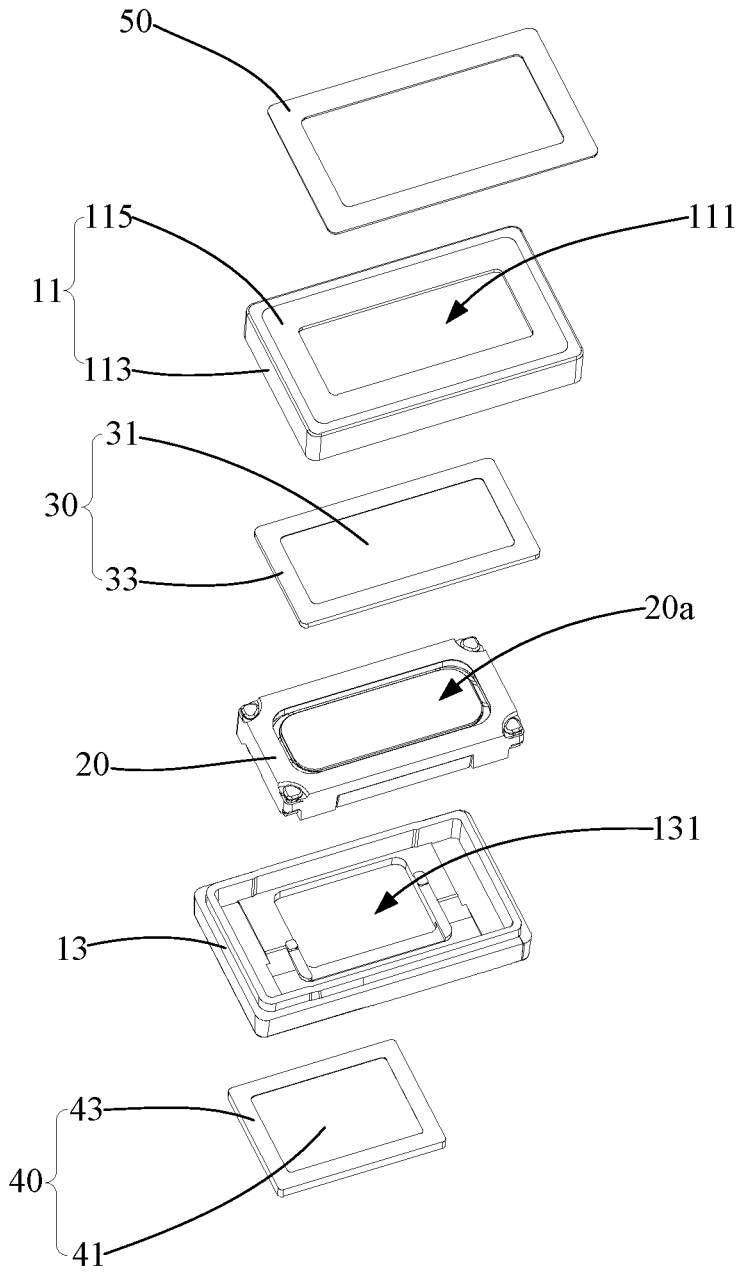
FIG. 3 is an exploded view of the sounding device in FIG. 1.
Figure 4:
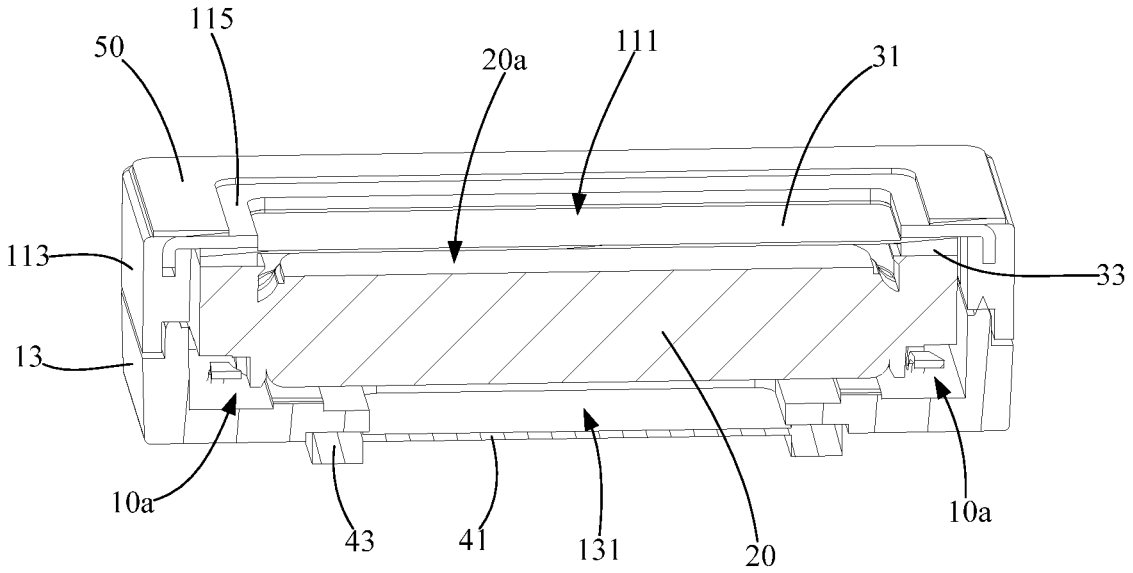
FIG. 4 is across-sectional view of the sounding device in FIG. 1.

In addition, it should be noted that, as shown in FIGS. 3 and 4, in this embodiment, the first housing 11 includes a housing body 113 and a connector 115, and the housing body 113 is covered on the second housing 13 and enclosed with the second housing 13 to define the accommodating cavity. At this time, an inner surface of the housing body 113 at the top defines the avoiding hole penetrating through the housing body 113, the side wall of the avoiding hole defines the installation groove, and, the installation groove is extended along a circumferential direction of the avoiding hole and communicated end to end to form an annular installation groove. At this time, the connector 115 is annular and has an outer periphery and an inner periphery. The connector 115 is arranged around the avoiding hole, and the outer periphery of the connector 115 is inserted and clamped in the installation groove, and the inner periphery of the connector 115 is enclosed to define the first sounding hole 111.

As shown in FIGS. 1 to 4, in an embodiment of the sounding device 100 of the present disclosure, the sounding device 100 further includes a dust-proof screen 30 arranged at the first sounding hole 111 and blocking the first sounding hole 111.

It should be noted that the dust-proof screen 30 may be provided on an outer surface of the housing 10. Specifically, an outer periphery of the dust-proof screen 30 is arranged around the first sounding hole 111, and is fixedly connected to the outer surface of the housing 10 surrounding the first sounding hole 111. At this time, a middle part of the dust-proof screen 30 is covered on the first sounding hole 111 from the outside, so that the dust-proof screen 30 plays a role of dustproof protection and adjustment of the acoustic performance of the first sounding hole 111. In addition, the fixed connection between the outer periphery of the dust-proof screen 30 and the outer surface of the housing 10 can be achieved either directly by gluing, or indirectly through an intermediate part such as a frame, a sealing ring, and other reasonable and effective ways.

Similarly, the dust-proof screen 30 can also be arranged on an inner surface of the housing 10, that is, on the cavity wall of the accommodating cavity. Specifically, the outer periphery of the dust-proof screen 30 is arranged around the first sounding hole 111, and fixedly connected to the cavity wall of the accommodating cavity surrounding the first sounding hole 111 (that is, fixedly connected to an inner surface of the housing 10 surrounding the first sounding hole 111). At this time, a middle part of the dust-proof screen 30 is covered on the first sounding hole 111 from the inside, so that the dust-proof screen 30 plays a role of dustproof protection and adjustment of the acoustic performance of the first sounding hole 111. In addition, the fixed connection between the outer periphery of the dust-proof screen 30 and the cavity wall of the accommodating cavity can be achieved either directly by gluing, or indirectly through an intermediate part such as a frame, a sealing ring, and other reasonable and effective ways.

Figure 5:
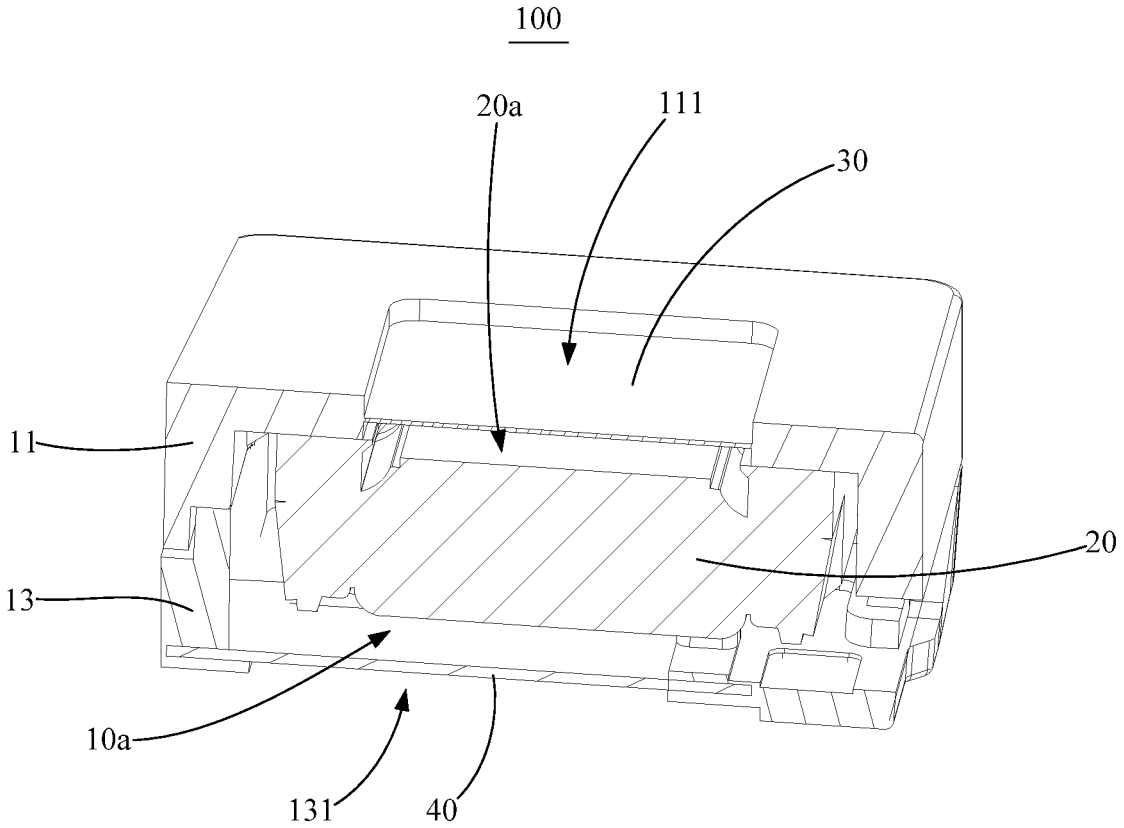
FIG. 5 is a schematic structural diagram of the sounding device according to another embodiment of the present disclosure.

In addition, the dust-proof screen 30 may also be arranged in the first sounding hole 111. Specifically, an outer periphery of the dust-proof screen 30 is arranged around the first sounding hole 111, and is fixedly connected to the side wall of the first sounding hole 111. At this time, a middle part of the dust-proof screen 30 blocks the first sounding hole 111 in the first sounding hole 111, so that the dust-proof screen 30 plays a role of dustproof protection and adjustment of the acoustic performance of the first sounding hole 111. In addition, the fixed connection between the outer periphery of the dust-proof screen 30 and the side wall of the first sounding hole 111 can be directly realized by integral injection molding (as shown in FIG. 5).

In addition, the dust-proof screen 30 in this embodiment can be either a conventional dust-proof screen or a dust-proof screen with waterproof function.

As shown in FIGS. 1 to 4, in an embodiment of the sounding device 100 of the present disclosure, the dust-proof screen 30 is accommodated in the accommodating cavity, the dust-proof screen 30 includes a screen 31 and a first frame 33 arranged around an outer periphery of the screen 31, the first frame 33 is arranged around the first sounding hole 111 and fixedly connected to a cavity wall of the accommodating cavity surrounding the first sounding hole 111, the screen 31 is covered on the first sounding hole 111, and a surface of the sounder 20 surrounding the front sounding hole 20*a* is arranged around and fixedly connected to the first frame 33.

Specifically, the first frame 33 is a waterproof gasket, and may further be a waterproof foam. The first frame 33 is glued or injection molded to an edge of the screen 31, and then one side of the first frame 33 and the edge of the screen 31 and the cavity wall of the accommodating cavity is adhesively fixed, and the other side is adhesively fixed to the surface of the sounder 20. After the elastic waterproof foam is squeezed, a better waterproof sealing effect between the sounder 20 and the housing 10 can be achieved.

Such an arrangement not only has simple structure, convenient manufacture, quick assembly, high stability and reliability, but also the dust-proof screen 30 is located in the accommodating cavity, which is not easily damaged and has good durability.

In addition, the screen 31 in this embodiment can be either a conventional dust-proof screen or a dust-proof screen with waterproof function.

As shown in FIGS. 1 to 4, in an embodiment of the sounding device 100 of the present disclosure, the sounding device 100 further includes a waterproof and breathable member 40 arranged at the second sounding hole 131 and blocking the second sounding hole 131.

It should be noted that the waterproof and breathable member 40 may be provided on the outer surface of the housing 10. Specifically, an outer periphery of the waterproof and breathable member 40 is arranged around the second sounding hole 131, and is fixedly connected to the outer surface of the housing 10 surrounding the second sounding hole 131. At this time, a middle part of the waterproof and breathable member 40 is covered on the second sounding hole 131 from the outside, so that the waterproof and breathable member 40 plays a role of dustproof protection and adjustment of the acoustic performance of the second sounding hole 131. In addition, the fixed connection between the outer periphery of the waterproof and breathable member 40 and the outer surface of the housing 10 can be achieved either directly by gluing, or indirectly through an intermediate part such as a frame, a sealing ring, and other reasonable and effective ways.

Similarly, the waterproof and breathable member 40 can also be arranged on an inner surface of the housing 10, that is, on the cavity wall of the accommodating cavity. Specifically, the outer periphery of the waterproof and breathable member 40 is arranged around the second sounding hole 131, and fixedly connected to the cavity wall of the accommodating cavity surrounding the second sounding hole 131 (that is, fixedly connected to an inner surface of the housing 10 surrounding the second sounding hole 131). At this time, a middle part of the waterproof and breathable member 40 is covered on the second sounding hole 131 from the inside, so that the waterproof and breathable member 40 plays a role of waterproof and breathable and adjustment of the acoustic performance of the second sounding hole 131. In addition, the fixed connection between the outer periphery of the waterproof and breathable 40 and the cavity wall of the accommodating cavity can be achieved either directly by gluing, or indirectly through an intermediate part such as a frame, a sealing ring, and other reasonable and effective ways.

In addition, the waterproof and breathable 40 may also be arranged in the second sounding hole 131. Specifically, an outer periphery of the waterproof and breathable member 40 is arranged around the second sounding hole 131, and is fixedly connected to a side wall of the second sounding hole 131. At this time, a middle part of the waterproof and breathable member 40 blocks the second sounding hole 131 in the second sounding hole 131, so that the waterproof and breathable member 40 plays a role of dustproof protection and adjustment of the acoustic performance of the second sounding hole 131. In addition, the fixed connection between the outer periphery of the waterproof and breathable member 40 and the side wall of the second sounding hole 131 can be directly realized by integral injection molding (as shown in FIG. 5).

In addition, for the waterproof and breathable member 40 in this embodiment, either a waterproof and breathable layer 41 can be directly selected, or the waterproof and breathable layer 41 can be selected with a frame on its outer periphery. Where, the waterproof and breathable layer 41 may be a single-layer structure including only one waterproof and breathable membrane, or a multi-layer composite structure including at least a waterproof and breathable membrane and a mesh. The waterproof and breathable membrane can be either a polytetrafluoroethylene waterproof and breathable membrane (EPTFE membrane), a thermoplastic polyurethane waterproof and breathable membrane (TPU membrane), a polyurethane waterproof and breathable membrane (PU membrane), or other waterproof and breathable membranes. The mesh can be PP anti-adhesive non-woven fabric or other mesh.

It is understandable that, in order to facilitate the assembly of the waterproof and breathable member 40 and improve the stability of the installation of the waterproof and breathable member 40, the waterproof and breathable member 40 includes a waterproof and breathable layer 41 and a second frame 43 arranged around an outer periphery of the waterproof and breathable layer 41, the second frame 43 is arranged around the second sounding hole 131, the waterproof and breathable layer 41 is covered on the second sounding hole 131, the second frame 43 is fixedly connected to a cavity wall of the accommodating cavity surrounding the second sounding hole 131 or fixedly connected to an outer surface of the housing 10 surrounding the second sounding hole 131. Specifically, the second frame 43 is a waterproof gasket, and may further be a waterproof foam. The second frame 43 is glued or injection molded to an edge of the waterproof and breathable layer 41, and then an edge of the second frame 43 and the waterproof and breathable layer 41 can be fixedly connected to the cavity wall of the accommodating cavity surrounding the second sounding hole 131, or fixedly connected to the outer surface of the housing 10 surrounding the second sounding hole 131 by glue or other reasonable and effective ways.

As shown in FIGS. 1 to 4, in an embodiment of the sounding device 100 of the present disclosure, the second frame 43 is fixedly connected to the outer surface of the housing 10 surrounding the second sounding hole 131. Such an arrangement is not only simple in structure, but also convenient in manufacture, quick in assembly, stable and reliable.

As shown in FIGS. 1 to 4, in an embodiment of the sounding device 100 of the present disclosure, in order to improve the sealing performance around the first sounding hole 111 of the product applying the sounding device 100 of the present disclosure, the sounding device 100 further includes a waterproof tape 50. The waterproof tape 50 is disposed on the surface of the housing 10 and around the first sounding hole 111.

Figure 6:
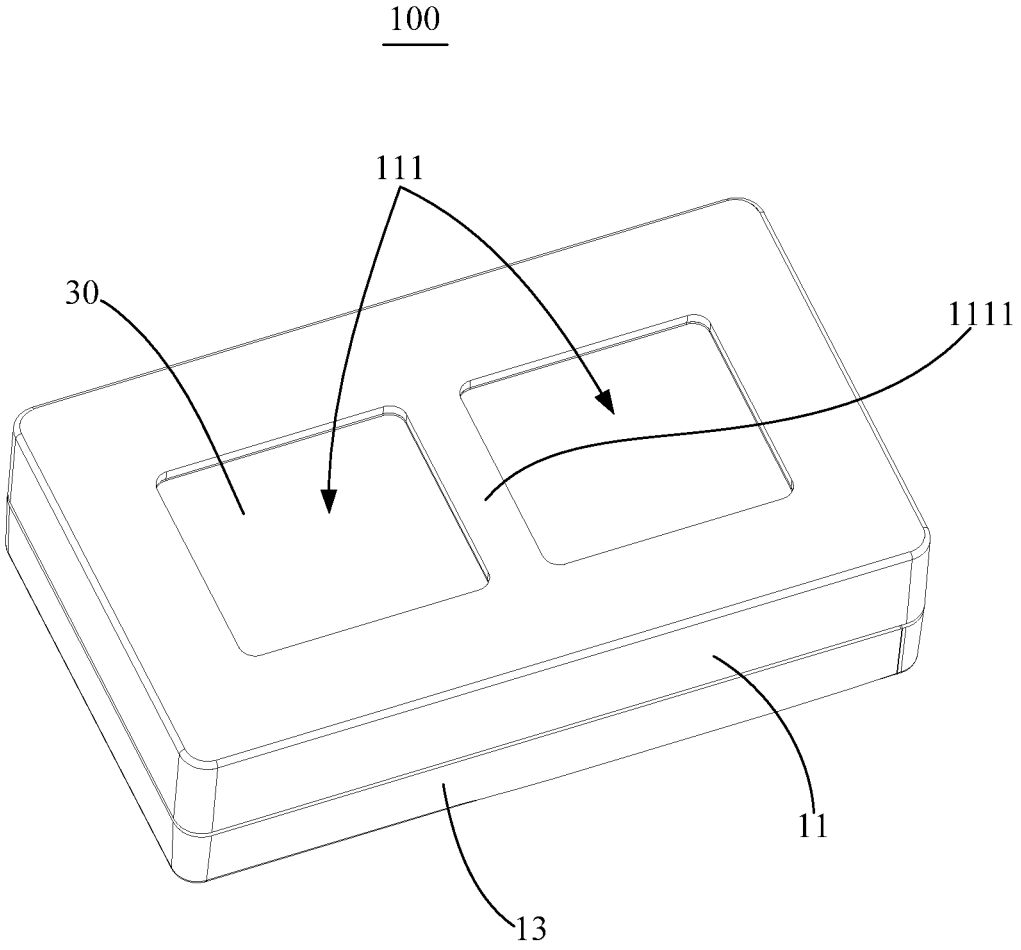
FIG. 6 is a schematic structural diagram of the sounding device according to still another embodiment of the present disclosure.

As shown in FIG. 6, in an embodiment of the sounding device 100 of the present disclosure, two opposite side walls of the first sounding hole 111 are provided with a reinforcing rib transversely 1111. In this way, the middle part of the dust-proof screen 30 can be fixedly connected to the reinforcing rib 1111, so that the installation stability thereof is enhanced, and the dust-proof screen 30 is prevented from vibrating due to the influence of the airflow.

Figure 7:
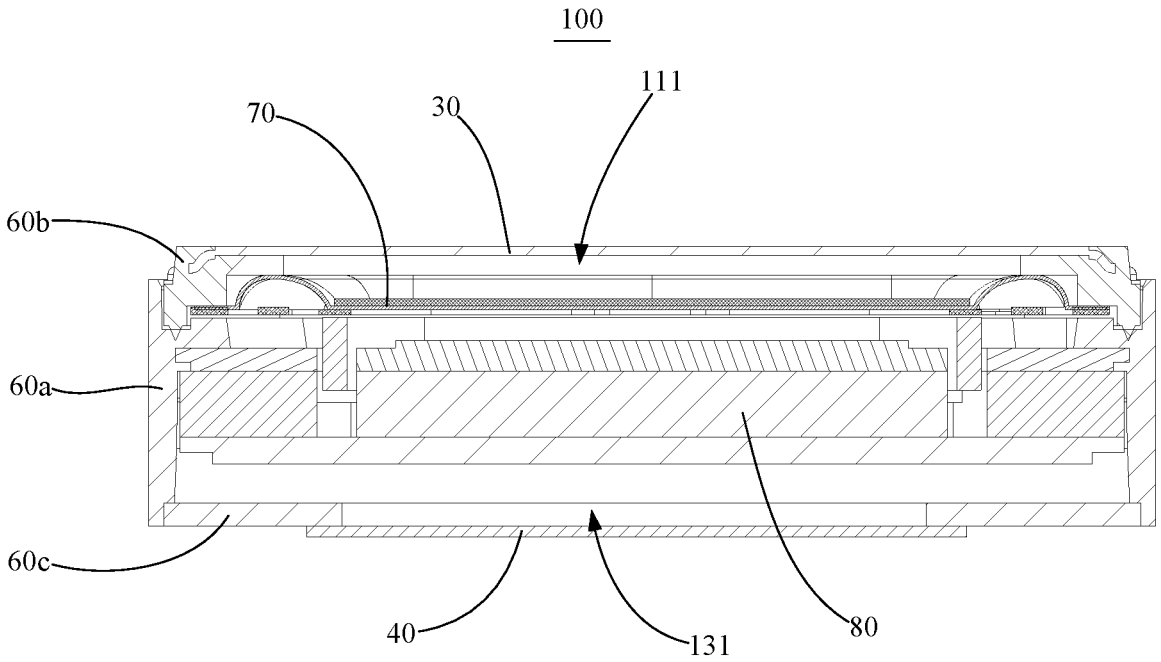
FIG. 7 is a schematic structural diagram of the sounding device according to a further embodiment of the present disclosure.

As shown in FIG. 7, in an embodiment of the sounding device 100 of the present disclosure, the sounding device 100 includes an annular frame 60*a*, the vibration system 70 is installed at a first end of the frame 60*a*, the magnetic circuit system 80 is installed inside the frame 60*a* and located below the vibration system 70, the frame 60*a* is further provided with a front cover 60*b* at the first end, the front cover 60*b* defines the first sounding hole 111, the frame 60*a* is provided with a rear cover 60*c* at a second end, and the rear cover 60*c* defines the second sounding hole 131.

In addition, in this embodiment, the sounding device 100 further includes a dust-proof screen 30 and a waterproof and breathable member 40 arranged at the second sounding hole 131 and blocking the second sounding hole 131. The dust-proof screen 30 is arranged at the first sounding hole 111 and blocks the first sounding hole 111.

In addition, it should be noted that a shape of the housing 10 can be set according to actual conditions, such as a rectangular parallelepiped shape, a cube shape, a cylinder shape, or other special shapes.

A shape of the first sounding hole 111 and a shape of the second sounding hole 131 can also be set according to actual conditions, for example, set to be circular, rectangular, square, or other special shapes.

Figure 8:
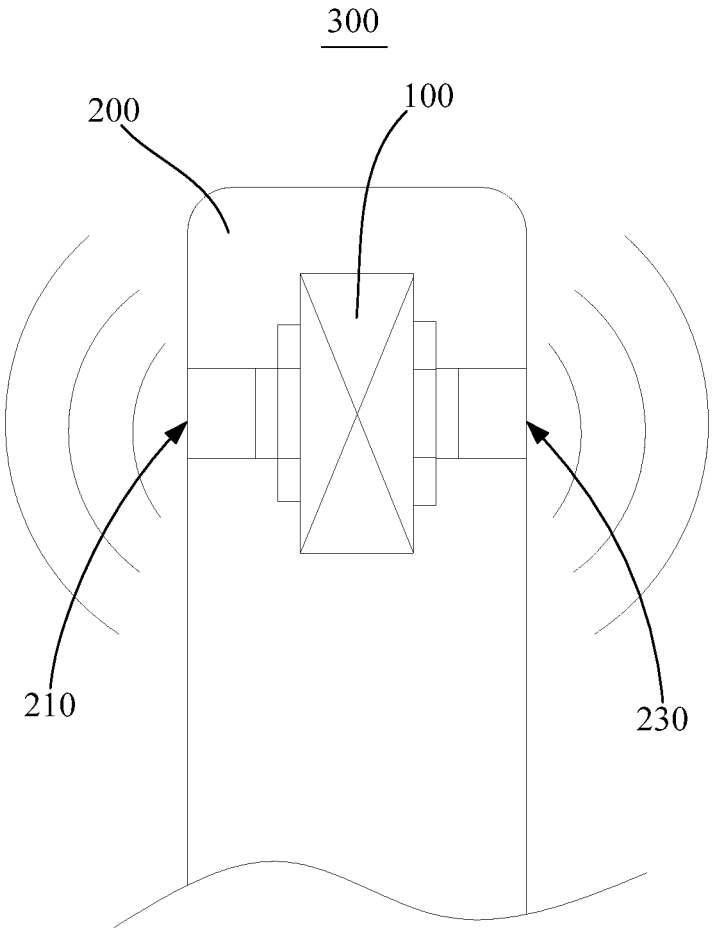
FIG. 8 is a schematic structural diagram of a terminal apparatus according to an embodiment of the present disclosure.

As shown in FIG. 8, the present disclosure further provides a terminal apparatus 300. The terminal apparatus 300 includes a protective shell 200 and the aforementioned sounding device 100 installed in the protective shell 200. The specific structure of the sounding device 100 may refer to the previous embodiments. Since the terminal apparatus 300 adopts all the technical solutions of all the foregoing embodiments, it has at least all the beneficial effects brought about by all the technical solutions of all the foregoing embodiments, which will not be repeated here. In order to correspond to the bidirectional sounding function of the sounding device 100, the protective shell 200 of the terminal apparatus 300 of the present disclosure further defines a first terminal sounding hole 210 in communication with the first sounding hole 111, and a second terminal sounding hole 230 in communication with the second sounding hole 131.

Specifically, the protective shell 200 includes a front face, a back face arranged oppositely to the front face, and a side face connecting the front face and the back face, the first terminal sounding hole 210 is defined on the front face of the protective shell 200, and the second terminal sounding hole 230 is defined on the back face of the protective shell 200 (as shown in FIG. 8); or, the first terminal sounding hole 210 is defined on the side face of the protective shell 200, and the second terminal sounding hole 230 is defined on the back face of the protective shell 200 (not shown); or, the first terminal sounding hole 210 is defined on the front face of the protective shell 200, and the second terminal sounding hole 230 is defined on the side face of the protective shell 200 (not shown).

The terminal apparatus 300 may be a mobile phone, a cordless phone, a notebook computer, a digital camera, a Bluetooth headset, a tablet computer, MP3, MP4, or other terminal apparatus 300.

The above is only preferable embodiments of this disclosure, and thus does not limit the scope of this disclosure, and the equivalent structural transformation made by the content of the specification and the drawings of this disclosure, or directly/indirectly applied to other related technical fields are all included in the patent protection scope of this disclosure.

What is claimed is:

1. A terminal apparatus, comprising a protective shell and a sounding device installed in the protective shell, wherein the sounding device comprises a vibration system and a magnetic circuit system; wherein, the vibration system comprises a vibration diaphragm comprising a first surface and a second surface facing away from the first surface;

the magnetic circuit system is located on a side of the second surface of the vibration diaphragm;

the sounding device defines a first sounding hole at a position in communication with a space on a side of the first surface, and a second sounding hole at a position in communication with a space on the side of the second surface; and the protective shell defines a first terminal sounding hole in communication with the first sounding hole, and a second terminal sounding hole in communication with the second sounding hole;

wherein the sounding, device further comprises:

a housing, defining an accommodating cavity therein, wherein the first sounding hole and the second sounding hole are defined on a cavity wall of the accommodating cavity; and a sounder comprising the vibration system and the magnetic circuit system, wherein the sounder is accommodated in the accommodating cavity and defines a front sounding hole and a rear sounding hole, the front sounding hole is in communication with the first sounding hole, and the rear sounding hole is in communication with the second sounding hole.

2. The terminal apparatus of claim 1, wherein the front sounding hole is defined on a top surface of the sounder, and the rear sounding hole is defined on a bottom surface or a side surface of the sounder.

3. The terminal apparatus of claim 1, wherein an air guiding channel is defined between a surface of the sounder and the cavity wall of the accommodating cavity, and the rear sounding hole and the second sounding hole are communicated through the air guiding channel.

4. The terminal apparatus of claim 1, wherein the sounder is fixedly connected to a cavity wall of the accommodating cavity surrounding the first sounding hole, and the front sounding hole and the first sounding hole are arranged oppositely.

5. The terminal apparatus of claim 1, wherein the accommodating cavity defines an avoiding hole spaced apart from the second sounding hole on the cavity wall, a connector is protruded from a side wall of the avoiding hole, a strength of the connector is higher than a strength of plastic, the connector is extended along a circumference of the avoiding hole, and an inner side of the connector defines the first sounding hole; and the sounder is fixedly connected to the connector, and the front sounding hole and the first sounding hole are arranged oppositely.

6. The terminal apparatus of claim 1, wherein the housing comprises a first housing and a second housing, the first housing is covered on the second housing and enclosed with the second housing to define the accommodating cavity, the first housing defines the first sounding hole, and the second housing defines the second sounding hole.

7. The terminal apparatus of claim 6, wherein the housing is in a rectangular parallelepiped shape, and the first sounding hole and the second sounding hole are arranged oppositely.

8. The terminal apparatus of claim 6, wherein the first housing and the second housing are glued or ultrasonically welded.

9. The terminal apparatus of claim 1, wherein the sounding device further comprises a dust-proof screen arranged at the first sounding hole and blocking the first sounding hole.

10. The terminal apparatus of claim 9, wherein the dust-proof screen is accommodated in the accommodating cavity, the dust-proof screen comprises a screen and a first frame arranged around an outer periphery of the screen, the first frame is arranged around the first sounding hole and fixedly connected to a cavity wall of the accommodating cavity surrounding the first sounding hole, the screen is covered on the first sounding hole, and a surface of the sounder surrounding the front sounding hole is arranged around and fixedly connected to the first frame.

11. The terminal apparatus of any one of claim 1, wherein the sounding device further comprises a waterproof and breathable member arranged at the second sounding hole and blocking the second sounding hole.

12. The terminal apparatus of claim 11, wherein the waterproof and breathable member comprises a waterproof and breathable layer and a second frame arranged around an outer periphery of the waterproof and breathable layer, the second frame is arranged around the second sounding hole, the waterproof and breathable layer is covered on the second sounding hole, the second frame is fixedly connected to a cavity wall of the accommodating cavity surrounding the second sounding hole or fixedly connected to an outer surface of the housing surrounding the second sounding hole;

or, the waterproof and breathable member is a waterproof and breathable layer, and an outer periphery of the waterproof and breathable layer is integrally molded on a side wall of the second sounding hole.

13. The terminal apparatus of any one of claim 1, wherein the sounding device further comprises a waterproof tape arranged on a surface of the housing and surrounding the first sounding hole;

and/or, two opposite side walls of the first sounding hole are provided with a reinforcing rib transversely.

14. The terminal apparatus of claim 1, wherein the sounding device comprises an annular frame, the vibration system is installed at a first end of the frame, the magnetic circuit system is installed inside the frame and located below the vibration system, the frame is further provided with a front cover at the first end, the front cover defines the first sounding hole, the frame is provided with a rear cover at a second end, and the rear cover defines the second sounding hole.

15. The terminal apparatus of claim 1, wherein the protective shell comprises a front face, a back face arranged oppositely to the front face, and a side face connecting the front face and the back face, the first terminal sounding hole is defined on the front face of the protective shell, and the second terminal sounding hole is defined on the back face of the protective shell; or, the first terminal sounding hole is defined on the side face of the protective shell, and the second terminal sounding hole is defined on the back face of the protective shell; or, the first terminal sounding hole is defined on the front face of the protective shell, and the second terminal sounding hole is defined on the side face of the protective shell.

* * * * *